United States Patent [19]

Shearhart

[11] 4,408,662

[45] Oct. 11, 1983

[54] RETRIEVABLE PACKER FOR OIL WELL CASING

[75] Inventor: Billy G. Shearhart, Nowata, Okla.

[73] Assignee: Sooner Oil Tools, Inc., Nowata, Okla.

[21] Appl. No.: 287,367

[22] Filed: Jul. 27, 1981

[51] Int. Cl.[3] ..... E21B 33/128; E21B 33/129

[52] U.S. Cl. ..... 166/124; 166/139; 166/387

[58] Field of Search ..... 166/139, 138, 216, 124, 166/134

[56] References Cited

U.S. PATENT DOCUMENTS

| | | | |
|---|---|---|---|
| 2,778,430 | 1/1957 | Baker | 166/139 |
| 3,338,308 | 8/1967 | Elliston et al. | 166/138 X |
| 3,385,366 | 5/1968 | Elliston | 166/139 X |
| 3,409,085 | 11/1968 | Oliver | 166/138 X |

*Primary Examiner*—Ernest R. Purser
*Assistant Examiner*—Michael J. Starinsky
*Attorney, Agent, or Firm*—Head, Johnson & Stevenson

[57] ABSTRACT

A retrievable packer for use in an oilwell casing, the packer having a central shaft with means at the upper end for attachment of an insertion or retrieval tool, an upper body portion having an opening receiving the shaft and having an integral downwardly extending tubular sleeve, the area around the sleeve providing an annular upper gland surface, a lower body portion having an opening receiving the shaft and a larger opening slidably receiving the sleeve and providing a lower annular flange surface, the lower body portion having a plurality of slots formed in vertical planes of the shaft axis, a baseplate having a threaded opening therein receiving the threaded lower end of the shaft, the baseplate serving to engage slips positioned in the slots so that as the shaft is rotated the baseplate moves up to force the slip into contact with the casing in which the packer is positioned, and an elastomeric packing gland of tubular cross-sectional shape received on the sleeve and between the upper and lower gland surfaces so that as the shaft is rotated the packing gland is compressed and radially outwardly expanded to seal the casing.

5 Claims, 10 Drawing Figures

RETRIEVABLE PACKER FOR OIL WELL CASING

CROSS-REFERENCE TO RELATED APPLICATIONS

Filed contemporaneously herewith is an application entitled: "ATTACHMENT MEANS FOR INSERTION AND RETRIEVAL OF A CASING PACKER". The contemporaneously filed application describes means wherein the packer of this invention may be positioned in a casing to seal off the interior of the casing and subsequently retrieved, and such copending application is incorporated herein by reference.

BACKGROUND OF THE INVENTION

1. Field of the Invention

This invention relates to packers of the type utilized in the petroleum industry in oil and gas wells wherein it is necessary to seal off one longitudinal section of a casing from the other. Particularly, the invention is related to a packer which is retrievable after it has been used to close off the upper from a lower portion of a casing.

2. Description of the Prior Art

The use of packers in the oil and gas industry is well known. For examples of prior art teachings of packers of the type to which this invention is related, reference may be had to the following U.S. patents:

Baker et al.—U.S. Pat. No. 2,806,536
Cypher—U.S. Pat. No. 2,888,079
Levendoski—U.S. Pat. No. 2,917,114
Crowe—U.S. Pat. No. 2,998,072
States—U.S. Pat. No. 3,171,491
Kelley—U.S. Pat. No. 3,294,171
Elliston—U.S. Pat. No. 3,330,357
Mullins—U.S. Pat. No. 3,889,750

While packers are well known as indicated by the above-referenced prior art, the present invention provides improvements in packers primarily of the type for use in wells of shallow to medium depths. The packer of this invention is relatively inexpensive to manufacture compared to other known packer designs. It is substantially failproof in operation and is particularly characterized by the ease with which the packer may be inserted into and retrieved from a casing.

SUMMARY OF THE INVENTION

A retrievable packer for use in a casing of an oil or gas well is described. The packer includes an elongated central shaft which is threaded at the lower end. Affixed to the upper end of the shaft is a means for attachment to the lower end of the string of tubing by which the packer is lowered into position from the surface of the earth. When in position the packer is set, that is, is actuated to close off the interior of the casing to provide a leakproof seal between the area of the casing below the packer relative to the area of the casing above the packer. The packer is also easily retrievable by means attached to the upper end of the shaft whereby the packer may be unset, that is, released from sealed engagement with the interior of the casing, and removed from the casing.

An upper body portion has an upper flange with an opening therein which rotatably receives the shaft. Integrally extending downwardly from the flange portion is a tubular sleeve, the outer diameter of which is less than the outer diameter of the flange, providing an upper annular gland surface around the sleeve. The shaft is coaxially received within the tubular sleeve. A lower body portion has an axial opening which receives the shaft and an enlarged diameter opening in the upper portion which slidably receives the sleeve. The upper end of the lower body portion provides an annular gland surface around the recess which receives the sleeve. The exterior of the lower end of the lower body portion is provided with a plurality of slots which are spaced apart from each other and are each in a vertical plane of the shaft axis. The slot surfaces are inclined inwardly towards the lower end of the lower body portion. A slip member is positioned in each of these slots. Each of the slip members has an inner tapered surface engaging the slot tapered surface and has an irregular outer surface for non-slidably engaging the casing in which the packer is positioned.

As baseplate has a threaded axial opening therein which receives the threaded lower end of the shaft. The upper end of the baseplate engages the slip members. Positioned between the upper and lower gland surfaces is a tubular packing gland made of elastomeric material such as natural or synthetic rubber. The interior diameter of the packing gland is such as to receive the sleeve so that the gland is supported about the sleeve and between the upper and lower gland surfaces.

When the packer is in position and the shaft rotated in one direction, the baseplate is drawn upwardly causing the slips to be forced outwardly by the inclined surface to engage the interior of the casing in which the packer is positioned. This supports the packer in the selected position within the casing. Further rotation of the shaft causes the lower body portion and upper body portion to move towards each other, compressing the packing gland to cause it to expand outwardly to engage the interior wall of the casing and thereby seal the casing area below the packer from the area above the packer.

To cause the baseplate to resist rotation when the shaft is rotated so that the elements of the packer advance towards each other, drag springs are attached to the lower end of the baseplate.

DESCRIPTION OF THE DRAWINGS

FIG. 1A shows a means of inserting the setting tool attached to the upper end of the packer.

FIG. 2A shows the insertion tool after it has been pulled from engagement with the packer.

FIG. 3A shows a tool for use in retrieving the packer.

DESCRIPTION OF A PREFERRED EMBODIMENT

Figure 1A:
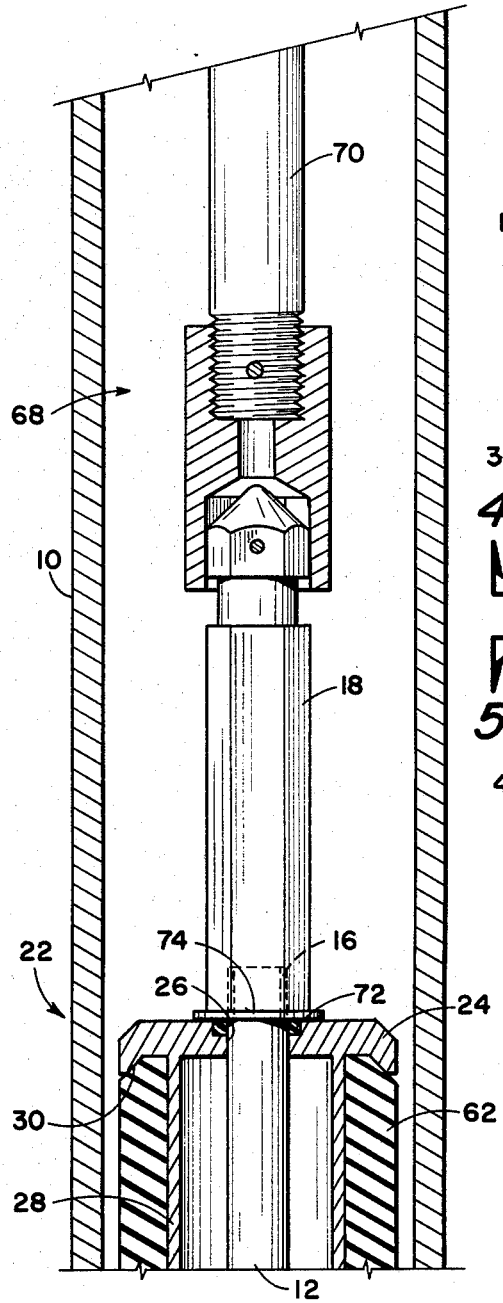
FIG. 1A shows the upper portion of a packer of this invention within a casing.
Figure 1B:
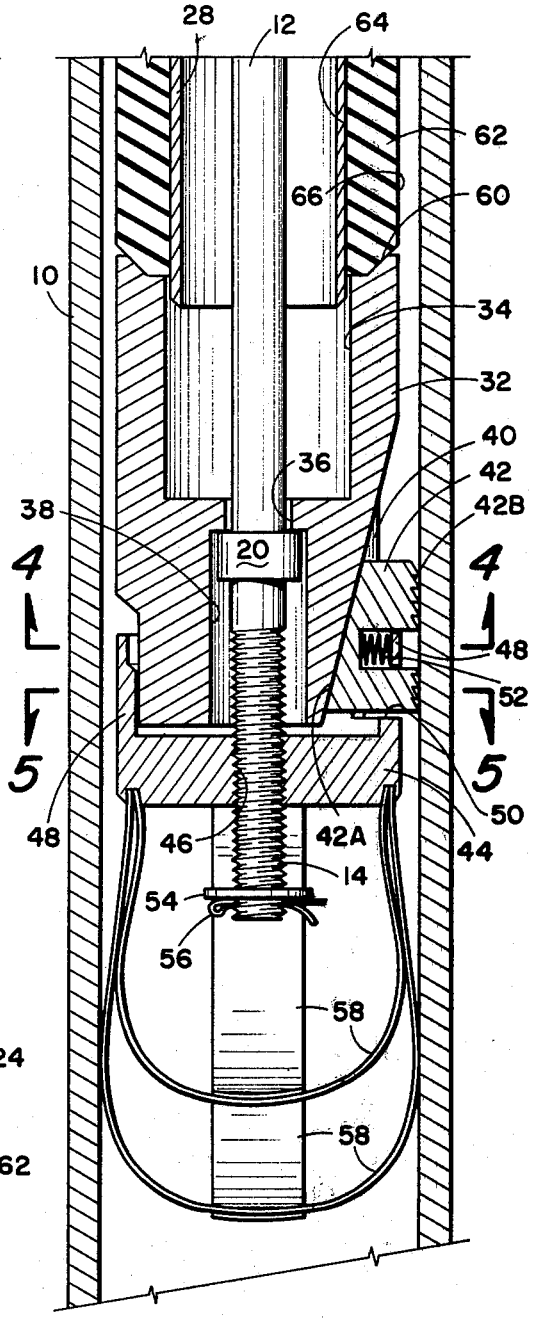
FIG. 1B shows the lower portion. The packer is shown as positioned within the casing preparatory to setting and showing the setting operation having advanced to the point where the slips are expanded outwardly to engage the interior wall of the casing but wherein compression of the packing gland has not yet taken place.

Referring to the drawings, first to FIGS. 1A and 1B, an embodiment of the invention is illustrated, it being understood that the embodiment here is for purposes of exemplification and that the invention is not limited to this embodiment. A length of casing 10 is shown which is not part of the invention but which is the environment in which the invention is used. After a well is drilled casing is positioned in the well to prevent the bore hole from falling in and to enable the oil and/or gas to be removed from the well. It is frequently necessary to provide means for closing off one area of the casing from the other, that is, an area below from an area above. This can be important when the casing passes through different formations. The casing can be cemented to seal the exterior of the casing relative to various formations and perforations can be placed in the casing to communicate the interior of the casing with various formations which are spaced apart elevationally within the earth. To seal the interior of the casing a packer of the type employed in this invention is utilized.

The packer employs a central vertical elongated shaft 12. The lower end of the shaft as shown in FIG. 1B includes threads 14 and a means is provided at the upper end for the attachment of an installation and retrieval tool. FIG. 1A shows this means in the form of thread 16 with an upstanding male location member 18 threadably affixed to it. The location member 18 is not a part of the present invention but is illustrated herein to exemplify a means whereby the packer may be inserted into or removed from a casing. The shaft 12 has, spaced from the lower threaded end 14, an integral enlarged diameter boss portion 20, the purpose of which will be described subsequently.

An upper body portion is generally indicated by the numeral 22 and includes a flange portion 24 having an axial opening 26 therein which rotatably receives shaft 12. Integrally extending downwardly from the flange portion 24 is a tubular sleeve 28, the exterior diameter of which is less than the interior diameter of the casing 10, and also less than the exterior diameter of the flange portion 24. This provides an annular upper gland surface 30 on the lower surface of flange 24 and exteriorly of the sleeve 28.

The next important element is a lower body portion 32 which has an upper internal recess 34 which slidably receives the lower end of sleeve 28. Lower body 32 also has an axial opening 36 rotatably receiving shaft 12 and a lower slightly larger internal diameter recess 38 which rotatably receives the shaft enlarged boss portion 20.

Figure 4:
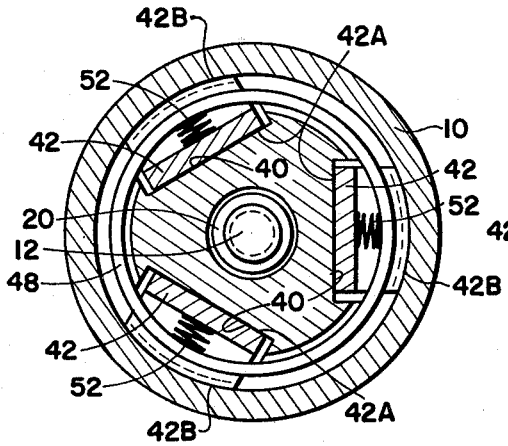
FIG. 4 is a cross-sectional view taken in an upward direction along the line 4—4 of FIG. 1B and showing the relationship between the shaft, the lower body portion, the slips and springs as employed in the invention.
Figure 5:
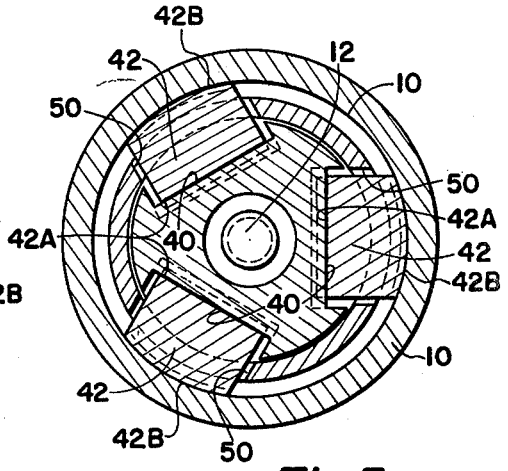
FIG. 5 is a cross-sectional view taken along the line 5—5 of FIG. 1B and showing the elements shown in FIG. 4 except for the springs which are not shown in FIG. 5. This cross-sectional view it taken in the downward direction.
Figure 7:
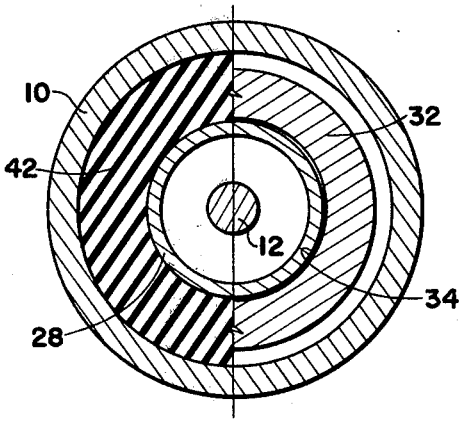
FIG. 7 is a cross-sectional view taken along the line 7—7 of FIG. 2B showing the relationship between the lower body portion, the sleeve, the packing gland and casing when the packer is in the set position in which the packing gland is in sealed engagement with the interior of the casing.
Figure 6:
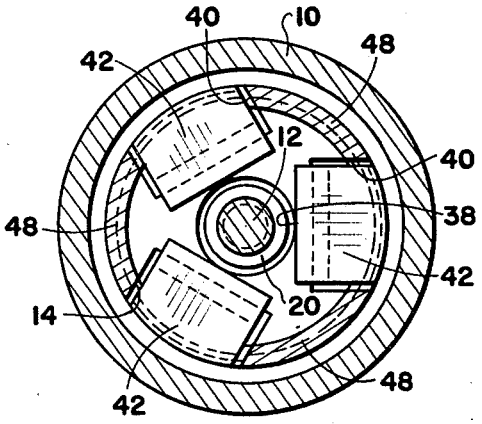
FIG. 6 is a cross-sectional view taken along the line 6—6 of FIG. 3B and shows more details of the relationship between the slips and the baseplate when the packer is in condition to be removed from or inserted into the casing, that is, in the nonset condition.

The lower body portion 32 has, at the lower end thereof on the external surface, a plurality (three being illustrated and three also being the minimum desired number) of tapered slots 40, only one of which is shown in FIG. 1B but which are shown in the cross-sectional view FIG. 4. Each of the slots has a tapered inside wall which is slanted inwardly towards the lower end of the body member 32. Received in each of the slots 40 is a slip member 42, each of which has an inclined inner surface 42A which corresponds with the lower body member inclined surfaces 40. The outer surfaces of the slip members 42 are irregular or provided with teeth 42B which nonslideably engage the interior cylindrical wall of casing 10.

The next member of the packer is the baseplate 44 which has a threaded opening 46 receiving the threaded portion 14 of shaft 12. Integrally extending upwardly from the external periphery of the baseplate 14 is a cylindrical portion 48. This portion 48 has slots 50 therein to receive each of the slip members 42 or, more precisely, to receive portions of each of the slip members 42. Springs interposed between the inner surface of the cylindrical portion 48 and the slip member 42 serve to urge the slip members inwardly towards the lower body portion 32.

Received on the lower end of shaft 12 is a washer 54 held by cotter key 56 which prevent the baseplate 44 from being unthreaded off the lower end of the shaft.

To allow the packer to slide in the casing 10 when in the nonset condition but to prevent the baseplate 44 from rotating when shaft 12 is rotated, a plurality of drag springs 58 are affixed to the lower surface of the baseplate. The drag springs are formed of leaves of flexible steel which expand outwardly to engage the interior of the casing 10 but which interpose no substantial resistance to the sliding up and down of the packer within the housing.

The upper end of lower body portion 32 surrounding the internal recess 34 provides a lower annular gland surface 60. Received on the sleeve 28 between the upper gland surface 30 and the lower gland surface 60 is a tubular packing gland 62 formed of elastomeric material, such as natural or synthetic rubber. The packing gland 62 has an internal cylindrical surface 64 which is slidable on the exterior of sleeve 28 and the external cylindrical surface 66 is of less diameter than the interior of the casing 10 so that in the nonset position the packing does not engage the interior of the casing.

Figure 3A:
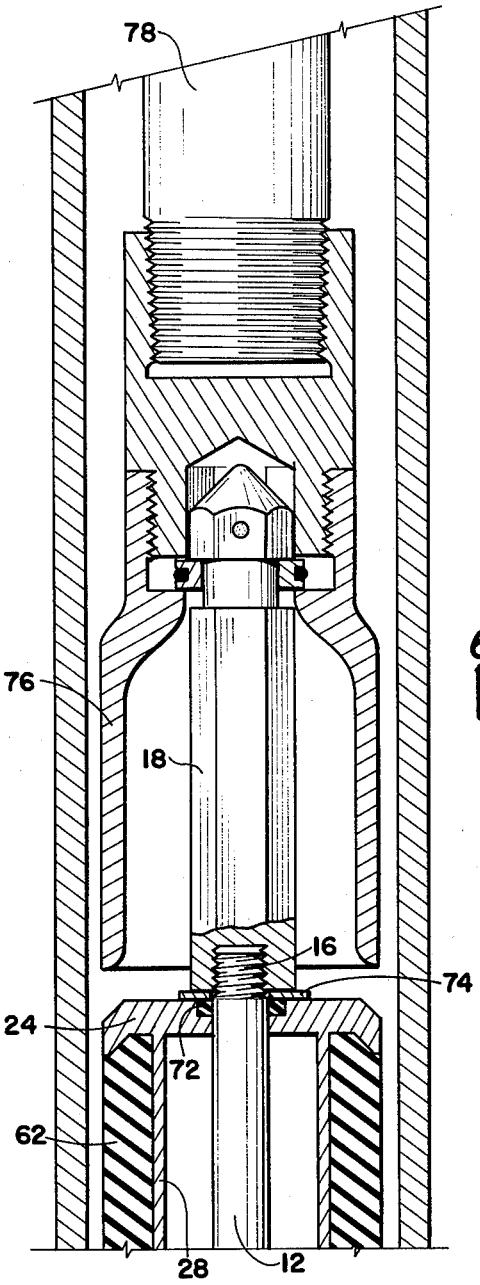
FIGS. 3A and 3B show the packer in a completely released condition, which is the condition in which the packer is inserted into or removed from a casing before any operation has taken place to set the packer or after the packer has been fully unset.
Figure 3B:
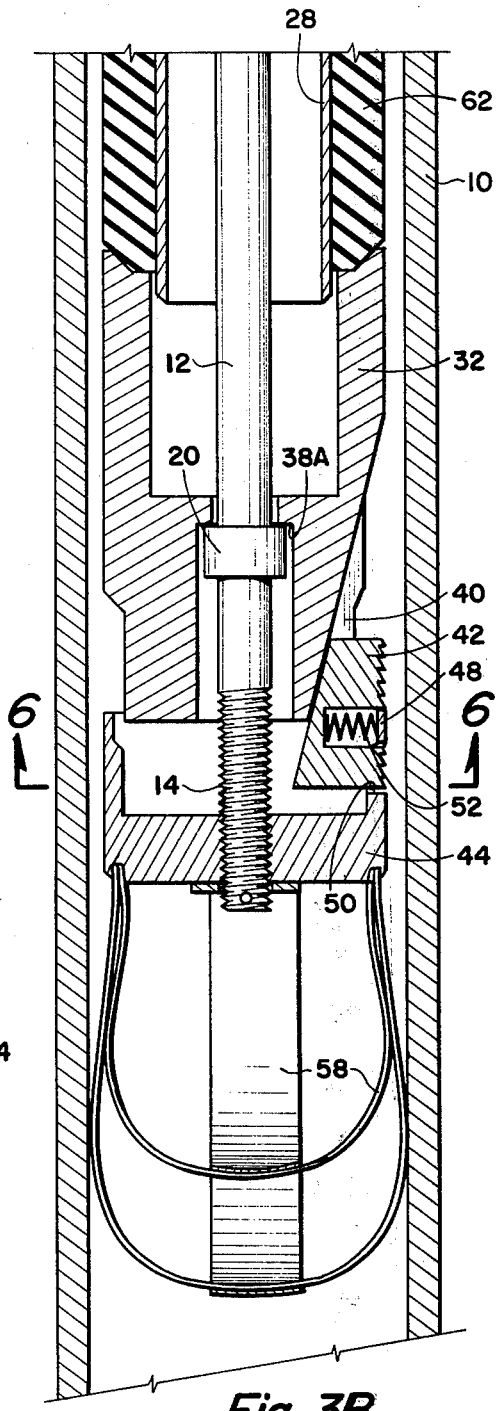

FIGS. 3A and 3B show all of the elements of the packer described up to this point in the fully nonset position, that is, wherein the baseplate 44 is in the downwardmost position and with the slip members 42 fully retracted and with the packing gland 32 in a noncompressed state. In this condition the only portion of the packer engaging the interior of the casing 10 is the drag springs 58. FIGS. 1A and 1B show the packer having been located to a desired position in casing 10 by means of an insertion tool 68 secured on the lower end of a string of tubing 70. The tubing 70 extends from the surface of the earth and is used to lower the packer into the casing 10 and to position it in the desired location. The packer is set or unset by the rotation of shaft 12. The relationship between the insertion tool 68 and the location member 18 are not a part of this invention and will not be described herein except to state that the tool supports the packer as it is lowered into the well by the string of tubing 70 and, after the packer is set, the insertion tool 68 is removed from contact with the packer by upward pull on the tubing.

FIGS. 1A and 1B show the packer placed in position and with the shaft 12 rotated so as to move the baseplate 44 upwardly towards the lower body portion 32. This causes the slip members 42 to slide outwardly in the tapered slots 40 so that the outer surfaces 42B engage the interior of casing 10. The engagement of the slip members with the casing secures the packer in the position in a nonslidable relationship with the casing and further resists any tendency of any of the portions of the packer to rotate as shaft 12 is continued to be rotated. Upon further rotation of the shaft the position of the elements of the packer take that shown in FIGS. 2A and 2B. Note that the slip members 42 are fully set against the interior of the casing and that the packing gland 62 has been longitudinally compressed causing it to radially expand outwardly so that the outer surface 66 is in sealed engagement with the casing internal surface. In the condition as shown in FIGS. 2A and 2B the packer has completely sealed the interior of the casing so that no fluid communication is provided within the casing between that portion below the packer and that portion above it.

To ensure that no leakage takes place along shaft 10, as shown in FIGS. 1A, the upper body portion flange 12 has an O-ring gasket 72 therein surrounding the shaft and a washer 74 seals against the O-ring. This permits the shaft 12 to be rotated but when the packer is in the set position the O-ring 72 prevents leakage along the shaft.

Figure 2A:
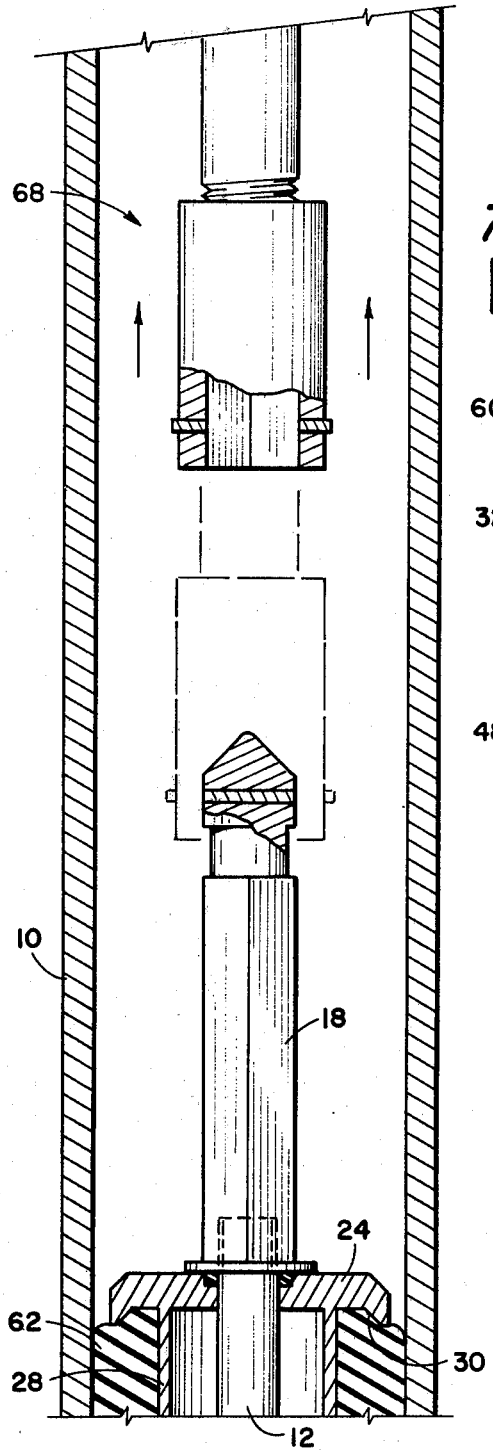
FIGS. 2A and 2B are similar to FIGS. 1A and 1B except that the packer is shown in a fully set position with the packing gland compressed so that it has expanded outwardly to seal against the interior wall of the casing.
Figure 2B:
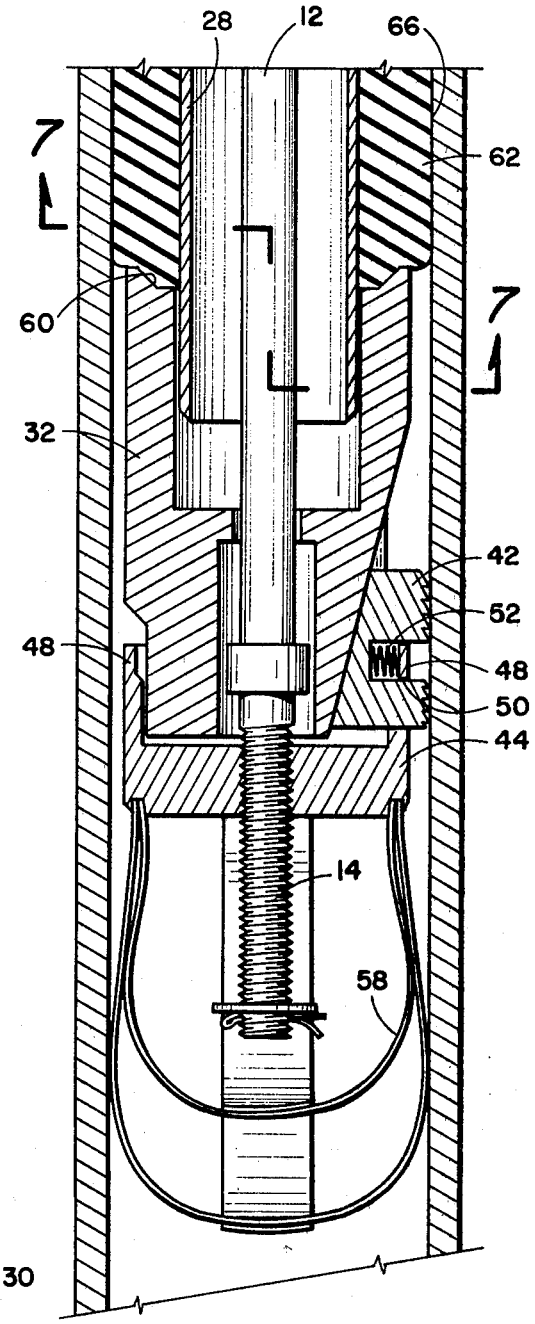

FIG. 2A also shows the insertion tool 68 removed from engagement with the location member 18 so that the packer is left in sealed condition to close off the portion of the casing interior below the packer from that portion above it.

FIG. 3A shows a retrieval tool 76 which also is not part of this disclosure. The retrieval tool is shown on the lower end of a tubing 78 as may be employed to retrieve the packer by removing it from the casing. To release the packer all that is required is that means be lowered from the earth's surface to engage the location member 18 and rotate it in the direction opposite the setting direction. This rotation causes the baseplate 44 to be moved in a direction away from the lower end of the lower body portion 32. This action first relieves pressure on the packing gland 12 allowing it to retract. As the reverse rotation is further applied to the shaft the slip members 42 are pushed downwardly retracting them from engagement with the casing. Note that the shaft enlarged diameter boss portion 20 engages the shoulder 38A formed by the recess 38 to ensure that the bottom plate 44 is forced downwardly relative to the lower bottom portion 32 so that the slips are fully withdrawn to disengage from the casing.

This preferred embodiment as described provides an effective, yet simplified packer having a minimum number of parts. It provides a packer which is easily insertable into a casing or retrieved from a casing. The action of the slip members is positive to engage or disengage the interior of the casing and the method of compressing to radially extend the packing gland is direct and foolproof.

While the invention has been described with a certain degree of particularity, it is manifest that many changes be made in the details of construction and the arrangement of components without departing from the spirit and scope of the disclosure. It is understood that the invention is not limited to the exemplified embodiments set forth herein but is to be limited only by the scope of the attached claim or claims, including the full range of equivalency to which each element thereof is entitled.

What is claimed is:

1. A retrievable packer for the casing of a well comprising:

an elongated central shaft being threaded at the lower end and having means at the upper end for attachment of insertion or retrieval tools;

an upper body portion providing an upper flange having an opening therein rotatably receiving said shaft and having a downwardly extending tubular sleeve, the outer diameter of the sleeve being less than the outer diameter of the flange portion providing an upper annular gland surface therearound;

a lower body portion having an opening therethrough receiving said shaft, the upper portion of the opening slideably receiving said sleeve, the upper end of the lower body providing a lower annular gland surface, the lower exterior portion of the lower body having a plurality of spaced apart slots therein each having an inner surface which tapers inwardly towards the body lower end;

a slip member slidably positioned in each of said slots in said lower body portion, each slip having an inner tapered surface engaging the slot tapered surface and having an irregular outer surface for non-slidably engaging a casing in which the packer is positioned;

a base plate having a threaded opening therein receiving the threaded portion of said shaft, the upper end of the base plate engaging said slip members; and a tubular packing gland of elastomeric material received about said sleeve with the upper end thereof in engagement with said upper body portion gland surface and the lower end thereof in engagement with said lower body portion annular gland surface whereby when said shaft is rotated one direction said bottom plate is upwardly advanced to force said slips outwardly to engage the interior of a casing and to compress said packing gland to expand outwardly to sealably engage the interior of a casing and when said shaft is rotated in the opposite direction to move said base plate in the downward direction to release compressive force and said packing gland to allow it to contract and to cause said lower body member to be upwardly displaced relative to said slips whereby said slips are radially inwardly retracted allowing the packer to be removed from the casing.

2. A retrievable packer according to claim 1 wherein said base plate has an integral upwardly extending cylindrical flange portion receiving the lower end of said lower body portion, the cylindrical flange portion having openings therein receiving portions of said slips whereby said slips are retained in position in said slots in said lower body portion.

3. A retrievable packer according to claim 2 including a spring interposed between said baseplate cylindrical flange portion and each of said slips to inwardly bias said slips towards said lower body portion.

4. A retrievable packer according to claim 1 wherein said shaft has an enlarged diameter boss spaced above the lower end, the threads on the shaft being below the boss, and wherein said lower body portion has an axial enlarged diameter opening rotatably receiving said boss, the length of the recess being less than the length of the threads on said shaft whereby when said shaft is rotated in the direction to release the packer the shaft boss engages the upper end of the recess to positively force said baseplate downwardly to cause said slips to be retracted.

5. A retrievable packer according to claim 1 including slidable means affixed to said baseplate to engage the interior of a casing to prevent the baseplate from rotating when said shaft is rotated.

* * * * *